United States Patent [19]

Kume et al.

[11] Patent Number: 4,589,254

[45] Date of Patent: May 20, 1986

[54] REGENERATOR FOR DIESEL PARTICULATE FILTER

[75] Inventors: Satoru Kume; Michiyasu Yoshida; Yoshihiro Konno; Tateo Kume, all of Kyoto; Hiroaki Takada, Hyogo; Kiyoichi Shinsei, Hyogo; Akio Matsumoto, Hyogo; Hitoshi Ogawa, Hyogo, all of Japan

[73] Assignees: Mitsubishi Jidosha Kogyo Kabushiki Kaisha; Mitsubishi Denki Kabushiki Kaisha, both of Japan

[21] Appl. No.: 630,053

[22] Filed: Jul. 12, 1984

[30] Foreign Application Priority Data

Jul. 15, 1983 [JP] Japan ..... 58-128780
Jun. 26, 1984 [JP] Japan ..... 59-131284

[51] Int. Cl.[4] ..... F01N 3/02

[52] U.S. Cl. ..... 60/286; 55/283; 60/289; 60/290; 60/311

[58] Field of Search ..... 60/289, 290, 286, 311; 55/DIG. 30, 283

[56] References Cited

U.S. PATENT DOCUMENTS 4,098,078 7/1978 Laurent ..... 60/290
4,404,795 9/1983 Oishi ..... 55/DIG. 30
4,450,682 5/1984 Sato ..... 60/311

*Primary Examiner*—Douglas Hart
*Attorney, Agent, or Firm*—Sughrue, Mion, Zinn, Macpeak and Seas

[57] ABSTRACT

An apparatus for controlling the supply of air to a burner used to recombust diesel particulates trapped in a ceramic filter. The inventive control apparatus includes an exhaust bypass line that bypasses the filter, an air supply line leading to a burner associated with the filter, a flow control valve that adjusts the cross-sectional area for the air flow in the air supply line, a relief valve that maintains a constant difference between pressures at points upstream and downstream of the flow control valve, and a control unit that controls the degree of opening of the flow control valve. With the invention, precise control over the flow rate of secondary air is ensured.

12 Claims, 12 Drawing Figures

REGENERATOR FOR DIESEL PARTICULATE FILTER

BACKGROUND OF THE INVENTION

The present invention relates to an apparatus for controlling the supply of air to a burner used to recombust diesel particulates trapped in a filter.

In order to prevent air pollution, particulates discharged from diesel engines are usually removed from the exhaust gas by a ceramic filter. At intervals, this diesel particulate filter is subjected to reburning for two purposes, regeneration of the filter and discharging the trapped particulates as a harmless substance. The reburning of the particulates requires a proper temperature and oxygen supply. If the burning temperature is too low, a significant amount of the particulates remains. If the burning temperature is excessively high, the filter itself is burnt.

A burner is frequently used as a heating source for the filter, and one of the atomization type, which atomizes the fuel with a small amount of primary air at a high pressure and burns the particulates with a large supply of secondary air at a low pressure, is most common. The optimum supply rate of the primary air to the burner is substantially proportional to the fuel supply rate, and in order to ensure a constant fuel flow rate, the flow rate of the primary air is usually kept constant. On the other hand, the secondary air flow is at low pressure but must be supplied in a large and controlled amount to ensure the gravimetric air flow rate necessary for burning the particulates. The secondary air is usually supplied by a positive displacement air pump, which type of pump ensures a constant volumetric air flow rate if the rotating speed is held constant. On the other hand, the required flow rate is sensitive to variations of the atmospheric pressure and ambient temperature, as well as in the pressure of the exhaust gas. It is therefore required that, with the use of a positive displacement air pump, any variation in the gravimetric flow rate be corrected without sacrificing the most significant advantage of this type of pump, namely, a high air discharge rate.

Common positive displacement air pumps have characteristics as shown in FIGS. 1 to 3. FIG. 1 shows an example of the volumetric flow rate vs. discharge pressure characteristics. From FIG. 1, it can be seen that, by reducing the cross-sectional area of an air line on the discharge side, the volumetric flow rate of air is decreased whereas its discharge pressure is increased. FIG. 2 shows an example of the gravimetric flow rate vs. discharge pressure characteristics for different altitudes at which the air pump is used; the results at a low altitude are indicated by the solid line whereas those at a high altitude are represented by the dashed line. As can be seen from this Figure, in order to obtain the same gravimetric air flow, the discharge pressure at high altitudes must be made lower than at low altitudes by increasing the cross-sectional area of the air line. Even if the altitude is the same, the gravimetric flow rate from the positive displacement air pump varies (as shown by the two dashed lines in FIG. 3) depending upon fluctuations in the pump performance and the atmospheric pressure.

An example of a conventional particulate filter system supplying secondary air with a positive displacement pump having the characteristics shown above is illustrated in FIG. 4. A diesel engine generally indicated at 1 includes a turbocharger 2 and a filter 5 in an exhaust line 3 at a point downstream of the turbocharger 2. The exhaust gas is discharged through a muffler 200 positioned downstream of the filter 5. A burner 4 is provided in the exhaust line 3 at a point upstream of the filter 5. The burner has an ignition unit using an ignition coil 6. The burner atomizes the fuel from a fuel pump 8 with primary air from a pump 7 whose flow rate is adjusted by a pressure regulating valve 201. At the same time, the burner uses secondary air from a pump 9 to produce a hot gas having a predetermined excess air ratio. Using the excess oxygen, the burner burns the particulates trapped in the filter 5. The cross-sectional area of a secondary air line 10 is adjusted by the operation of a flow control valve 11, and a vacuum chamber for actuating the switching operation of this valve is connected to a vacuum pump (negative pressure source) 12 via a vacuum regulating valve 13 and a solenoid valve 14.

With the system shown in FIG. 4, it is necessary that the flow of exhaust gas have no adverse effects on the regeneration of the particulate filter. In order to meet this requirement, as shown in FIG. 4, the exhaust line 3 is provided with a bypass 202 that is connected to the line 3 at two points, one upstream and the other downstream of the line. A valve switch 210 is positioned at the upstream junction between the exhaust line 3 and bypass 202. The valve switch 210 is driven by a link mechanism connected to a diaphragm 203 which further communicates with the vacuum pump 12. A solenoid valve 204 is provided between the diaphragm 203 and vacuum pump 12. The solenoid valve 204 is composed of a plunger 205, a coil 206 and a spring 207. When the coil 206 is energized, the plunger 205 is attracted toward the coil 206, thereby opening the valve 204. Then, the negative pressure in the vacuum pump 12 acts on the diaphragm 203 and the valve switch changes its position from a to b so as to close the exhaust line 3. As a result, the exhaust gas from the engine 1 is guided to the muffler 200 through the bypass 202. Accordingly, the exhaust gas from the engine 1 has no effect on the combustion in the burner 20. In FIG. 4, reference numerals 17 and 18 indicate a fuel regulating valve and a pressure regulating valve, respectively. Reference numeral 15 indicates a controller for controlling the ignition coil 6, air pumps 7 and 9, solenoid valve 14 and the fuel regulating valve 17. Reference numeral 16 refers to an atmospheric pressure sensor.

When the filter 5 is overloaded with particulates from the engine 1, the controller 15 detects with the senosr 19 that the pressure in the exhaust line at a point upstream of the filter 5 has exceeded a preset value, and upon detection of this fact, the controller initiates reburning of the particulates in the filter. If the engine is running at a high altitude where low atmospheric pressure is prevalent, an input signal from the atmospheric pressure sensor 16 causes the controller 15 to produce the necessary output to the solenoid valve 14 so as to increase the cross-sectional area of the secondary air line to a level which is greater than the reference level by a given amount. This produces an increase in the volumetric air flow rate that compensates for the decrease in the gravimetric flow rate due to a drop in the density of air. However, this system simply controls the change in the level of atmospheric pressure by the flow control valve 11 which relies on a diaphragm that receives a constant negative pressure. A significant problem with this diaphragm system is its inability to control the flow of secondary air with high accuracy, and this is particularly so if the characteristics of the secondary air pump vary.

SUMMARY OF THE INVENTION

The primary purpose of the present invention is to provide a burner air control apparatus for use with a diesel particulate filter system that ensures a precise control over the flow rate of secondary air.

The control apparatus of the present invention comprises an exhaust bypass line that bypasses the filter, an air supply line leading to the burner, a flow control valve that adjusts the cross-sectional area of the flow in the air supply line, a relief valve that maintains a constant difference between the pressure at points upstream and downstream of the flow control valve, and a control unit that controls the degree of opening of the flow control valve.

DESCRIPTION OF THE PREFERRED EMBODIMENTS

Figure 1:
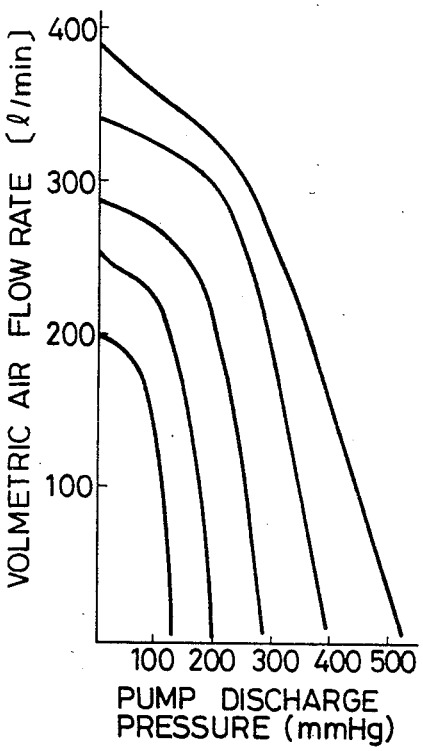
FIG. 1 is a graph showing the discharge pressure versus volumetric air flow of a positive displacement air pump.
Figure 2:
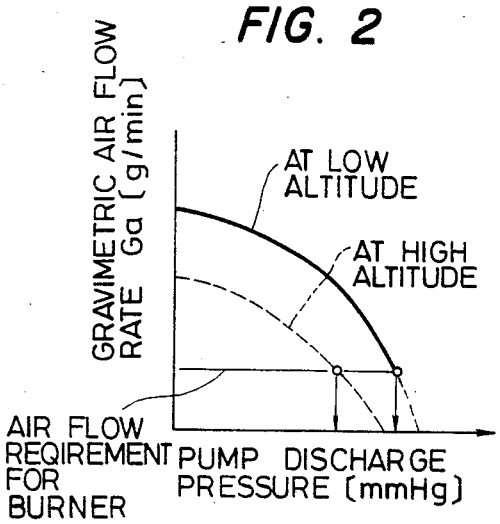
FIG. 2 is a graph showing changes in gravimetric air flow with altitude.
Figure 3:
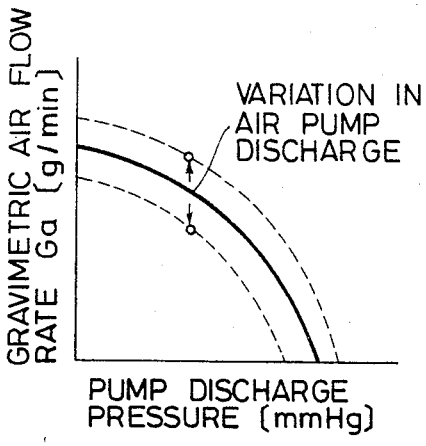
FIG. 3 is a graph showing variations in the gravimetric flow of air discharged from the air pump.
Figure 4:
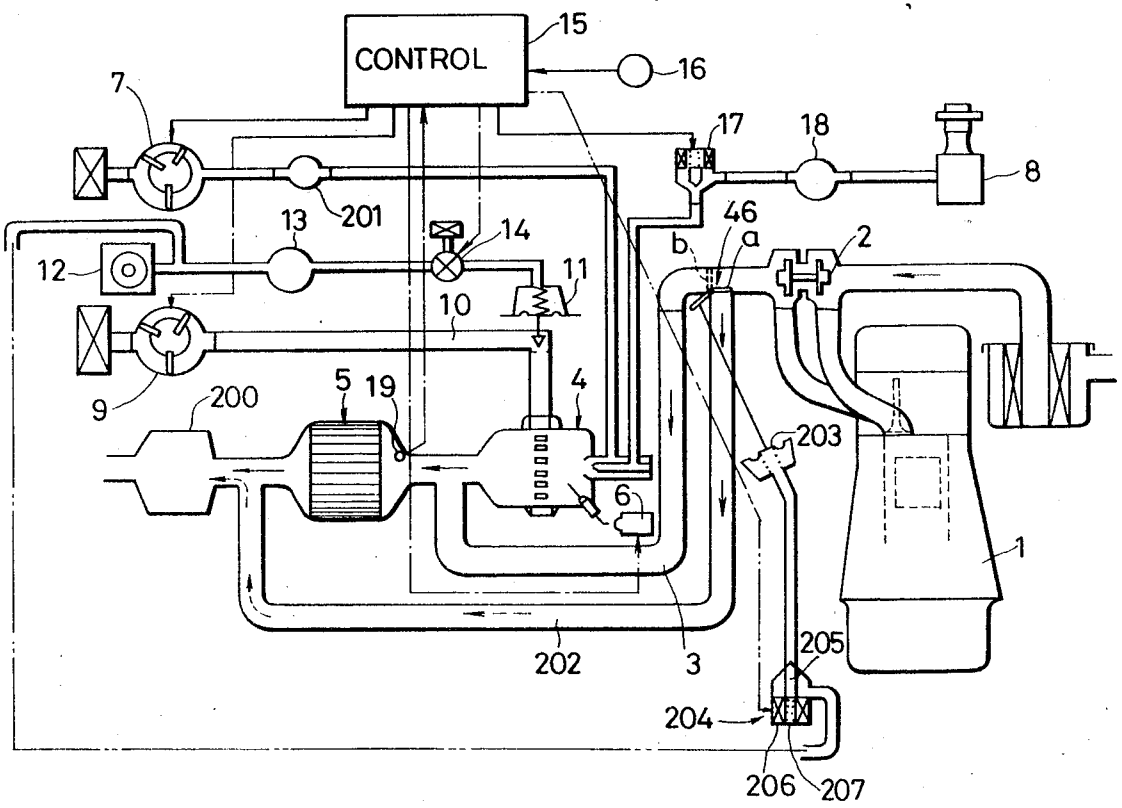
FIG. 4 is a schematic diagram of a conventional burner air control system.
Figure 5:
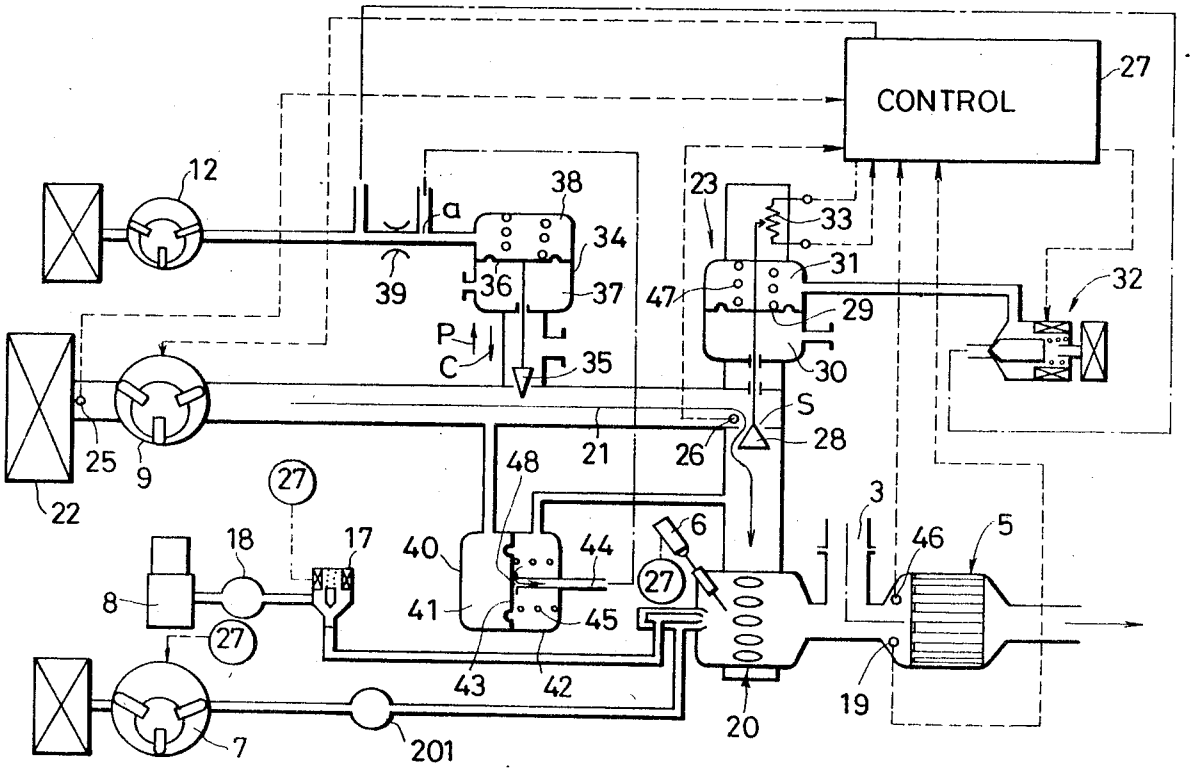
FIGS. 5, 7, 8, 10, 11 and 12 are schematic diagrams showing various embodiments of a burner air control system of the present invention.

FIG. 5 shows the burner air control apparatus for use with a diesel particulate filter system according to a preferred embodiment of the present invention. This burner air control apparatus includes components which are the same as those used in the conventional system shown in FIG. 4, and components common to both Figures are identified by like reference numerals.

A burner 20 that supplies the filter 5 on the exhaust line 3 with hot air having a predetermined temperature and excess oxygen ratio receives secondary air that is supplied from the secondary air pump 9 through a secondary air line 21. The secondary pump 9 causes secondary air to flow into the secondary line 21 through an air filter 22, and supplies this air into the burner 20 through a flow control valve 28 that adjusts the cross-sectional area for the air flow in the secondary line 21. The secondary line 21 has an atmosphere temperature sensor 25 disposed between the air filter 22 and secondary pump 9, as well as a pressure sensor 26 that detects the pressure in the secondary line at a point upstream of the flow control valve 28. The output signals of the two sensors are transmitted to a combustion control unit 27 for controlling the flow of the secondary air.

A valve drive unit 23 has a diaphragm 29 connected integrally with the flow control valve 28. This diaphragm divides the unit 23 into a chamber 30 which is open to the atmosphere and a negative pressure chamber 31 provided with a compressive spring 47. The flow control valve 28 is positioned in the secondary air line 21 in such a manner that it is capable of varying the cross-sectional area for the air flow in that line. The negative pressure chamber 31 is connected to a vacuum pump 12 (negative pressure source) through a duty solenoid valve 32. The duty valve 32 switches on and off the plunger at a frequency 10 to 20 Hz for selecting between two modes, one communicating the negative pressure chamber 31 with the vacuum pump 12, and the other introducing atmospheric pressure into the chamber 31. The pulse width that determines the time period during which the plunger remains in the on position is controlled by the output signal from the combustion control unit 27. In response to this output signal, the value of the negative pressure in the chamber 31 is changed and the flow control valve 28 is shifted to a position where the bias of the compressive spring is balanced with the atmospheric pressure, thereby changing the cross-sectional area S for the air flow in the line 21. When the flow control valve 28 shifts from the fully open position to the fully closed position, a position sensor 33 feeds back the amount of this shift to the control unit 27 as an output signal corresponding to a variable electrical resistance.

The secondary line 21 is provided with a relief valve 34 that causes the secondary air to be released into the atmosphere at a point between the flow control valve 28 and the secondary pump 9. This relief valve has a diaphragm 36 which is integral with the plunger 35 and divides the valve apparatus into a chamber 37 which is open to the atmosphere and a negative pressure chamber 38. The negative pressure chamber 38 is connected to the vacuum pump 12 through a flow control throttle 39. A negative pressure regulating valve 40 is connected to a negative pressure regulating line a connected between the throttle 39 and the negative pressure chamber 38.

The negative pressure regulating valve 40 is divided into a front chamber 41 and a rear chamber 42 by a diaphragm 43; the front chamber 41 receives a static pressure at a point upstream of the flow control valve 38, whereas the back chamber 42 receives a static pressure at a point downstream of the valve 28. The chamber 42 is provided with a compressive spring 45 and a pipe 44 whose opening 48 may be closed by the diaphragm 43 working as a plunger. The other end of the pipe 44 is connected to the negative pressure regulating line a. If the differential pressure across the flow control valve 28 is such that the valve closing force exerted by the diaphragm 43 exceeds the valve opening force of the compressive spring 45, the opening 48 of pipe 44 is closed. Otherwise, the pipe 44 remains open. In this latter case, the throttle 39 is actuated and air flows from the rear chamber 42 through the negative pressure regulating line a into the negative pressure chamber 38, with the result that the pressure in the chamber 38 increases to shift the plunger 35 in the valve closing direction C. On the other hand, if the opening 48 of the pipe 44 is closed, only the negative pressure from the vacuum pump 12 is applied to the line a and the plunger 35 shifts in the valve opening direction P.

Essential parts of the combustion control unit 27 are implemented with a microcomputer. The unit receives output signals from the pressure sensor 26, atmospheric temperature sensor 25, position sensor 33 and an emission temperature sensor 46. The control unit 27 adjusts the volumetric flow rate of secondary air to the proper level depending upon the detected atmospheric temperature and the pressure in the secondary line at a point upstream of the flow control valve 28, and at the same time, the unit performs proper adjustment of the fuel flow rate according to the detected temperature of the exhaust gas from the burner.

In greater detail, the gravimetric flow rate $G_a$ of secondary air is given by:

$$G_a = SC\sqrt{2\Delta P \cdot \rho}, \quad (1)$$

where S is the cross-sectional area of the air flow line, $\Delta P$ is the differential pressure across flow control valve 38, and $\rho$ is the density of air at a point upstream of the flow control valve 28. In the embodiment under consideration, P is held constant, whereas C, which is a coefficient of the flow rate, can be assumed to be substantially constant. Therefore, by correcting S to cancel a change in $\rho$, $G_a$ can be held constant.

Equation (1) can be rewritten as follows in terms of the temperature and pressure of air:

$$S = G_a / C\sqrt{2\Delta P \cdot \rho} = K\sqrt{T/P}, \quad (2)$$

where T is the temperature of air at a point upstream of the flow control valve 28, P is the pressure of air at a point upstream of the flow, and K is a constant of proportionality.

Equation (2) shows that, if T increases, $G_a$ can be held constant by increasing S, whereas if P increases, the same result can be obtained by decreasing S. It should be noted that since S corresponds directly to the lift of the flow control valve 28, a map or some other kind of reference table that indicates the required lifts for various values of T and P may be used for the purpose of maintaining $G_a$ at a constant level. In Equation (2), P is assumed to be the pressure of air at a point upstream of the flow control valve 28, but in fact, P may be the pressure in the secondary line 21 at any point near the control valve 28, and Equation (2) is still valid if the pressure of air at a point downstream of the flow control valve 28 is substituted for P.

Figure 6:
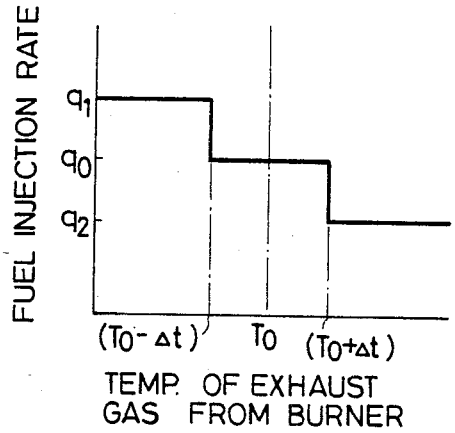
FIG. 6 is a graph showing the temperature of exhaust gas from the burner versus the fuel supply rate.

The theory by which the fuel control unit 27 controls the fuel injection rate q so as to keep the temperature T of the exhaust gas from the burner constant is illustrated in FIG. 6. If T is below the reference value $T_0$ by a difference greater than a preset value $\Delta t$, the fuel is injected at a rate $q_1$ which is greater than the reference value $q_0$, whereas if T exceeds $T_0$ by more than $\Delta T$, the fuel is injected at a rate $q_2$ which is smaller than $q_0$.

The operation of the burner air control apparatus shown in FIG. 5 proceeds as follows. The pressure sensor 19 detects the pressure of exhaust gas at a point upstream of the filter 5, and if the detected value exceeds a preset level, the apparatus 27 initiates the particulate burning mode. First, it issues signals to turn on the primary and secondary air pumps 7 and 9 as well as fuel pump 8 and ignition coil 6. At the same time, in response to an output signal from the sensor 46 that detects the temperature of the exhaust gas from the burner, the apparatus 27 furnishes the fuel regulating valve 17 with an input signal that adjusts the fuel injection from $q_0$ to $q_1$ if the detected temperature is lower than the reference $T_0$, and makes an adjustment from $q_0$ to $q_2$ if the detected temperature is higher than $T_0$. The negative pressure regulating valve 40 detects the differential pressure across the flow control valve 28 and controls the relief valve 34 so that the difference between the pressure in the secondary line 21 at a point downstream of the valve 28 and the pressure at a point upstream of that valve is held equal to the preset value limited by the compressive spring 45. Stated more specifically, if the differential pressure across the control valve 28 exceeds the preset level, the pipe 44 is closed and the entire negative pressure generated by the vacuum pump 12 is applied to the negative pressure chamber 38, whereupon the plunger 35 shifts in the valve opening direction P by a relatively long stroke and causes the air flowing in the secondary line to be released into the atmosphere. If the differential pressure across the control valve 28 is lower than the preset level, the pipe 44 becomes open and the air in the rear chamber 42 flows into the negative pressure regulating line a. As a result, the chamber 38 receives only a relatively low negative pressure, and thus the plunger 35 shifts in the valve closing direction C so as to suppress the air discharge from the secondary line 21. These pneumatic operations are the only requirement for the system of FIG. 5 to maintain a constant differential pressure across the flow control valve 28.

The negative pressure chamber 31 of the valve drive unit 23 receives negative pressure through the duty valve 32. The combustion control unit 27 determines the specific lift position of the valve 28 that is capable of obtaining the required gravimetric flow rate $G_a$ of secondary air. For this purpose, the unit may use a map in which various valve lift positions have been stored on the basis of the ambient temperature and the pressure in the secondary line at a point upstream of the control valve 28. In order to bring a signal indicative of the determined lift position into agreement with the output signal from the position sensor 33, the combustion control unit 27 performs feedback control on the duty valve 32 by adjustment of the duty factor. The map for various lift positions of the control valve 28 is preloaded into the control unit 27 after determining the proportionality constant K and other necessary factors through experimentation on the basis of Equation (2). By this procedure, the secondary air flowing through the secondary line 21 is adjusted to achieve a constant gravimetric flow rate before it is supplied to the burner 20.

As will be understood from the foregoing description, even if there occurs a change in the density of air due to variations in the operation of the secondary air pump 9 or fluctuations in the atmospheric temperature or the pressure in the secondary line 21 at a point upstream of the flow control valve 28, the differential pressure across the valve 28 is held constant by pneumatically operating the relief valve drive unit 34, and at the same time, the duty valve 32 is controlled by the unit 27 in such a manner that it corrects the cross-sectional area S of the air flow in the line 21 to a predetermined value, thereby cancelling any variations due to changes in the ambient temperature or the pressure in the line 21 at a point upstream of the control valve 28. As a result, the flow rate of the secondary air is controlled with high precision, and moreover, there is no need for the combustion control unit 27 to effect control to compensate for variations in the discharge of the secondary pump 9, which contributes to increased simplicity of the overall system.

With the burner air control system of FIG. 5, the differential pressure across the control valve 28 on the secondary line 21 is detected by the negative pressure regulating valve 40, and in response to the detected signal output, the negative pressure in the line a is properly corrected to operate the relief valve drive unit 34.

Figure 7:
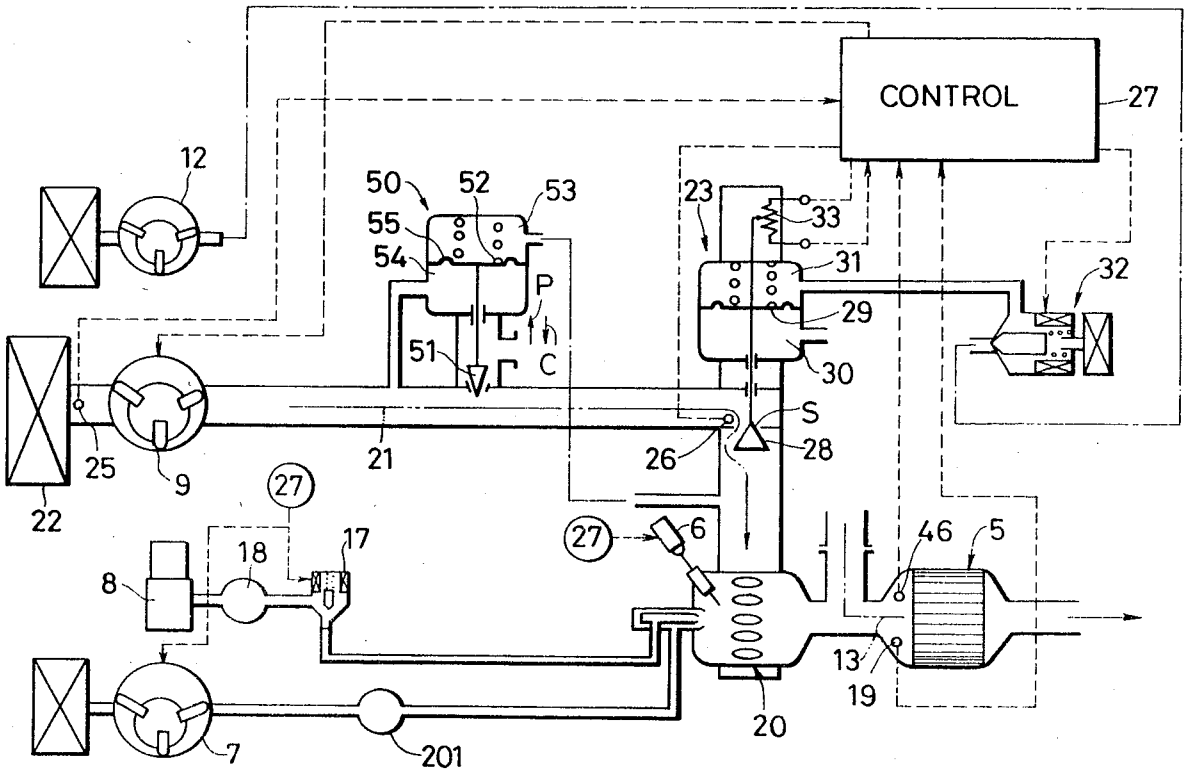

This drive unit 34 may be replaced by another type of drive unit 50 which, as shown in FIG. 7, releases air from the secondary line 21 into the atmosphere and is directly operated by the difference between the pressure at a point upstream of the flow control valve 28 and the pressure at a point downstream thereof. This unit is divided into a rear chamber 53 and a front chamber 54 by a diaphragm 55. The rear chamber is provided with a compressive spring 52 that depresses a relief valve 51 in the valve closing direction C, whereas the front chamber receives a pressure developed between the flow control valve 28 and the secondary pump 9. The combustion in the two chambers exerts a pneumatic pressure on the diaphragm. If the depressive force due to the differential pressure across the relief valve 51 exceeds the force exerted by the spring 52, the relief valve 51 shifts in the valve opening direction P, and in the contrary case, the valve shifts in the closing direction C. By this valve operation, variations in the discharge of air from the secondary pump 9 can be eliminated and a consistent air flow supplied to the flow control valve 28. One particular advantage of the system shown in FIG. 7 is that it does not require the use of the negative pressure regulating valve 40 included in the embodiment of FIG. 5. However, the compressive spring 52 must have a high spring constant sufficient to overcome the depressive force of the secondary air in the front chamber 54, thereby providing a downstroke for the valve 51 in the closing direction C.

Figure 9:
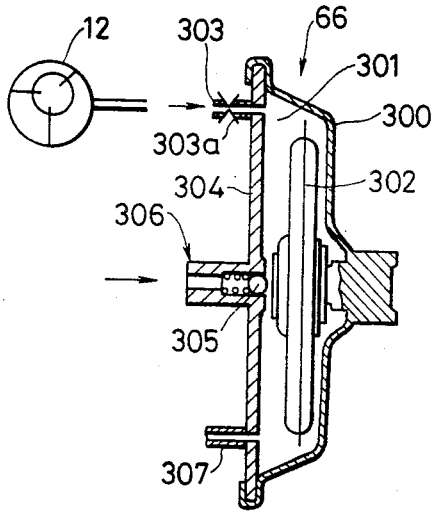
FIG. 9 is a longitudinal sectional view of a typical example of a constant pressure source.

In the burner air control apparatus of FIG. 5, the valve drive unit 23 is operated with signals from the combustion control unit 27, sensor 26 for detecting the pressure in the secondary line 21 at a point upstream of the valve 28, and the ambient temperature sensor 25. Alternatively, the same results may be obtained by a flow control valve 61 (see FIG. 8) that is controlled only by the atmospheric pressure. This valve 61 is connected integrally to a diaphragm 62 in a drive unit 60 that is separated by this diaphragm into a chamber 63 which is open to the atmosphere and a constant pressure chamber 65 having a compressive spring 64 that exerts a depressive force acting in the valve opening direction P. The chamber 65 is connected to a constant pressure source 66 that produces a constant pressure with respect to the absolute pressure. A typical configuration of the constant pressure source 66 is shown in FIG. 9. The valve consists of a constant pressure chamber 301 enclosed with a hermetic housing 300, a vacuum bellows 302 disposed within the chamber 301, a negative pressure pipe 303 having a throttle 303 and communicating the vacuum pump 12 with the constant pressure chamber 301, a pressure release pipe 306 one end of which is open to the atmosphere and which has incorporated therein a spring 304 and a spherical ball 305 as shown in FIG. 9, and a communicating pipe 37 for supplying a constant pressure. When the pressure in the chamber 301 decreases, the vacuum bellows 302 inflates to press the spherical ball 305 in the pipe 78, whereupon atmospheric pressure is applied to the chamber 301 through the pipe 78. As a result, the pressure in the chamber 301 increases to contract the bellows 302, whereupon the ball 305 returns to the position where it closes the pipe 306. By repeating this procedure, the pressure in the chamber 301 is held at a generally constant level.

This pneumatic control system is operated as follows. When the atmospheric pressure decreases such as at high altitudes, the flow control valve 61 shifts in the opening direction P so as to increase the cross-sectional area S, and hence the volumetric flow rate of the air passing through the secondary line 21. If the atmospheric pressure increases, the valve 61 shifts in the closing direction C, thereby reducing S, and hence the volumetric flow rate, of the air passing through the line 21. By this operation, the secondary air is made to flow through the line 21 at a substantially constant gravimetric flow rate. The control system shown in FIG. 8 has a simplified configuration and requires fewer components.

Figure 8:
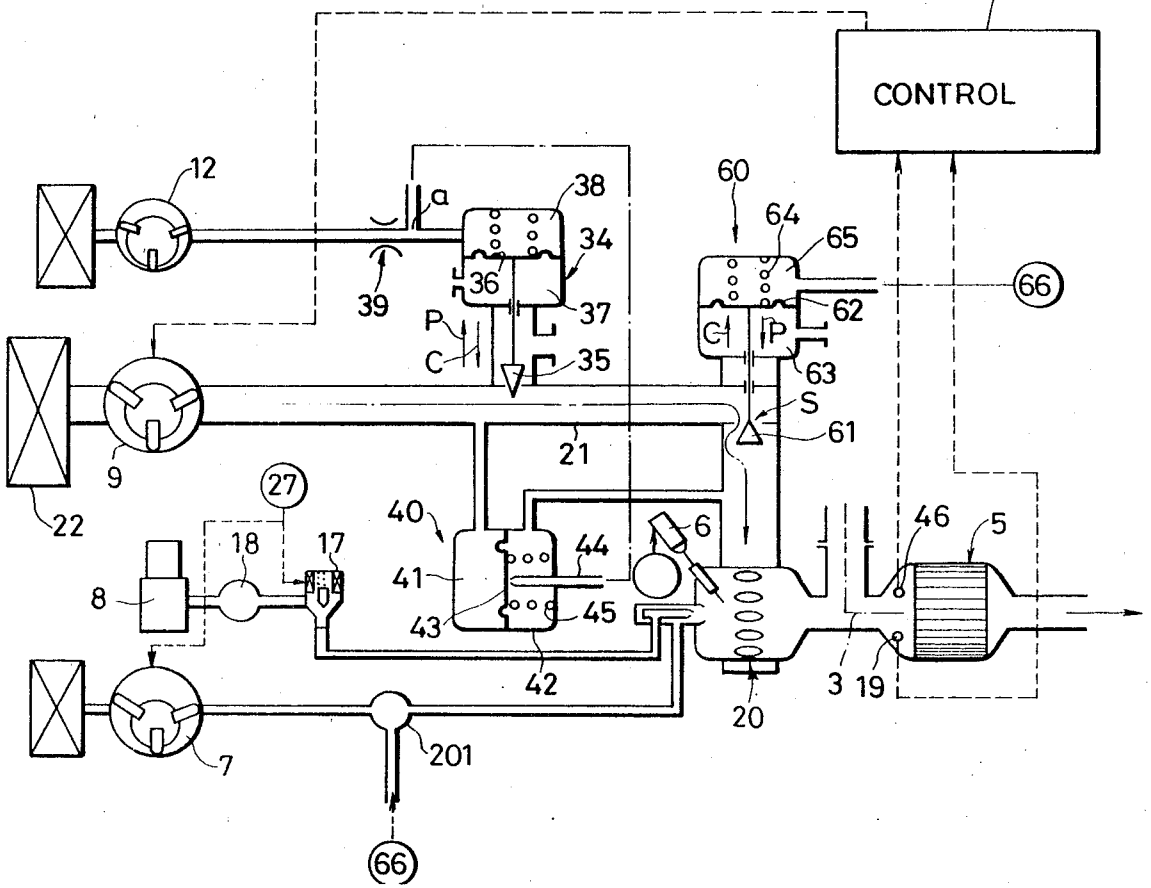
Figure 10:
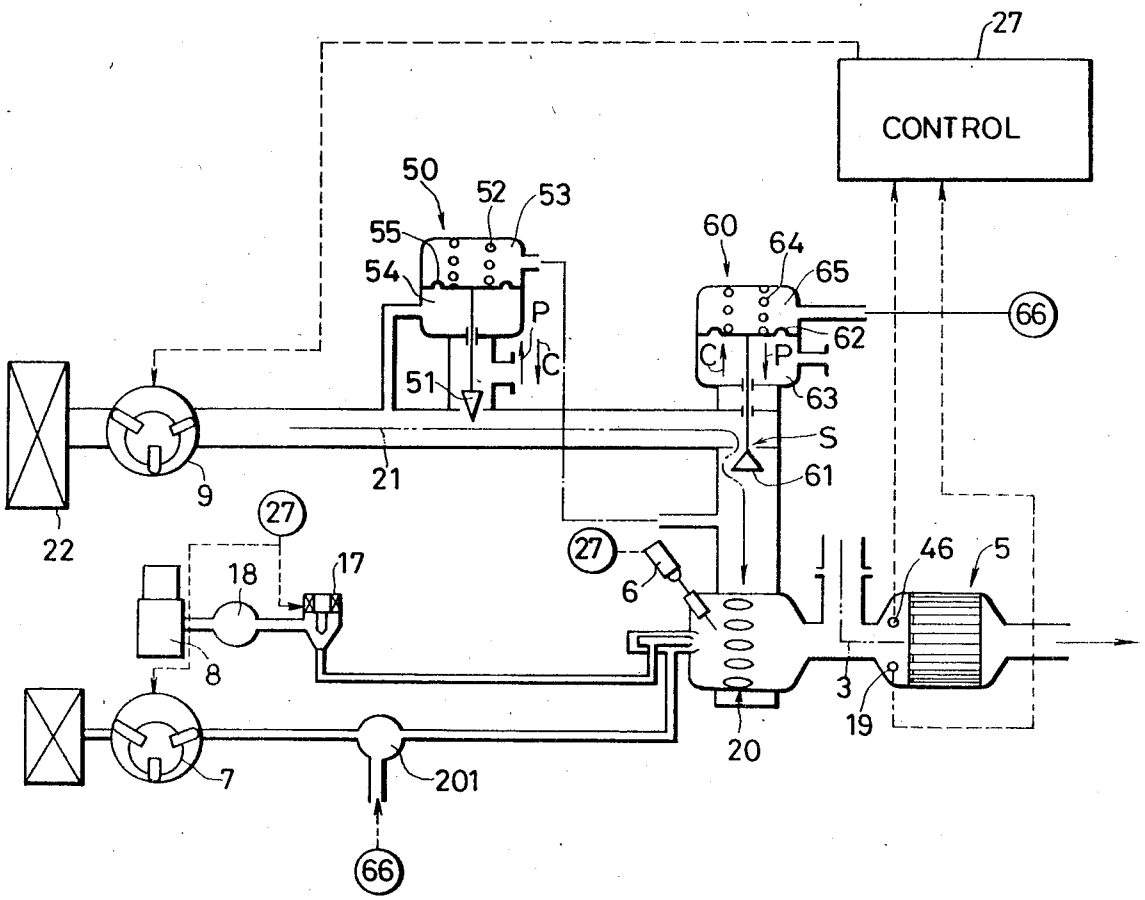

FIG. 10 shows another embodiment of the burner air control system of the present invention wherein the relief valve drive unit 50 shown in FIG. 7 and the flow control unit 60 depicted in FIG. 8 are provided on the secondary line 21. This embodiment is characterized by the use of an even smaller number of components since the valve of each unit is controlled pneumatically.

Figure 11:
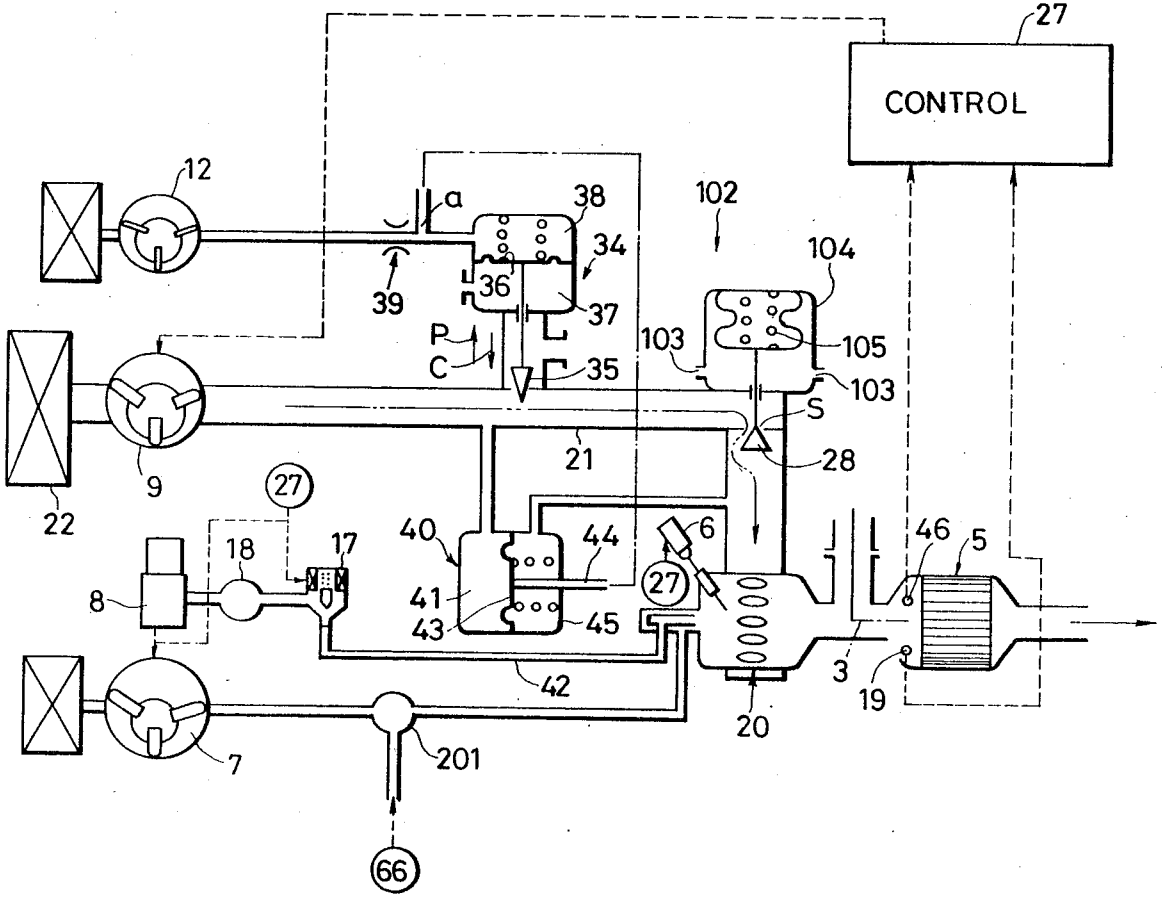
Figure 12:
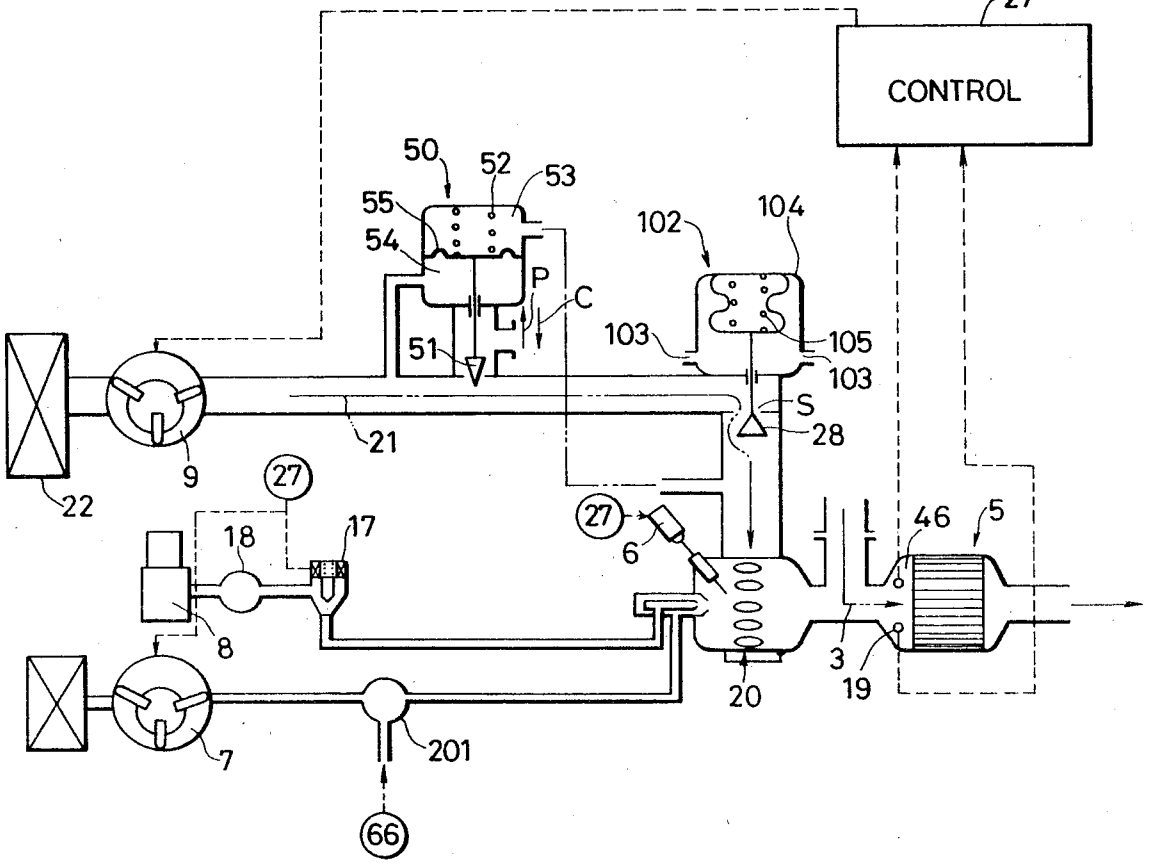

As shown in FIGS. 11 and 12, the flow control units 23 and 60 may be replaced by a flow control unit 102 which performs direct control over the flow control valve 28 by means of a bellows 100, the interior of which is maintained as a vacuum. Referring to FIG. 11, the flow control unit 102 consists of the bellows 100 connected to the valve 28, a casing 104 which encloses the bellows and is open to the atmosphere, and spring 105 provided within the bellows. When the pressure of the atmosphere is low, the bellows 101 expands to the extent determined by the balance between the ambient atmospheric pressure and the biasing force of the spring 105, and as a result, the valve 28 descends to increase the cross-sectional area S for the air flow. If, on the other hand, the atmospheric pressure is high, the bellows 100 contracts, with the result that the valve 28 ascends to reduce S.

It may be appreciated that the embodiment of FIGS. 11 and 12 provides a very simple system for controlling the cross-sectional area S for the air flow in the secondary line 21 depending upon the level of the atmospheric pressure. The flow control unit 102 shown in FIG. 12 is the same as used in the embodiment of FIG. 11, where like components are identified by like reference numerals.

The control unit shown in FIG. 5 is such that the cross-sectional area S for the air flow in the secondary line 21 is varied depending upon both the ambient temperature and the pressure in the secondary line at a point upstream of the flow control valve 28. It should be understood that S may be varied depending upon only one of these two parameters. Alternatively, other parameters may be added, such as the engine speed and load.

What is claimed is:

1. In a filter regenerating apparatus comprising a particulate filter provided in an exhaust gas line from a diesel engine for trapping particulates in exhaust gas from said engine, an exhaust bypass for bypassing said particulate filter, and a burner provided upstream of said particulate filter receiving fuel and air, said exhaust gas being passed through said bypass while said particulates, when trapped in said filter in an amount exceeding a preset level, are burnt in said burner, the improvement wherein said apparatus further comprises a line for supplying air into said burner through an air supply unit, a flow control valve provided in said air supply line for regulating a cross-sectional area of said line, a flow control unit for positioning said flow control valve depending upon at least one of a temperature and pressure of air in said supply line, a relief valve provided in said supply line for releasing part of the air in said line to the atmosphere, a relief valve control unit for positioning said relief valve depending upon a difference between a pressure in said supply line at a point upstream of said flow control valve and a pressure at a point downstream thereof, and a combustion control unit for establishing a timing of filter regeneration, thereby causing the exhaust gas to flow into said bypass and actuating said burner.

2. The apparatus according to claim 1, wherein said flow control unit comprises pressure-responsive means comprising a chamber receiving atmospheric pressure, a chamber receiving a predetermined constant pressure, a diaphragm partitioning said two chambers and connected to said flow control valve, and a spring for biasing said diaphragm, said pressure-responsive means being so constructed that a drop in atmospheric pressure increases an amount of opening of said flow control valve.

3. The apparatus according to claim 1, wherein said flow control unit comprises pressure-responsive means comprising a bellows connected to said flow control valve and a casing enclosing said bellows and having an opening to the atmosphere, said pressure-responsive means being so constructed that a drop in atmospheric pressure causes said bellows to expand.

4. The apparatus according to claim 1, wherein said relief valve control unit comprises a first chamber into which said pressure in said supply line at a point downstream of said flow control valve is introduced, a second chamber into which said pressure in said supply line at a point upstream of said flow control valve is introduced, a diaphragm partitioning said first and second chambers operatively associated with said relief valve, and a spring for biasing said diaphragm, said relief valve control unit being so constructed that said relief valve is opened when said pressure in said supply line at a point upstream of said flow control valve exceeds said pressure downstream of said valve by a value greater than a preset level.

5. The apparatus according to claim 1, wherein said relief valve control unit comprises: a negative pressure regulating valve comprising a first chamber into which said pressure in said supply line at a point downstream of said flow control valve is introduced, a second chamber into which said pressure upstream of said flow control valve is introduced, a first diaphragm partitioning said first and second chambers, and a first spring for biasing said first diaphragm; a relief valve drive unit comprising a negative pressure chamber connected to a negative source through a first line, a chamber receiving atmospheric pressure, a second diaphragm partitioning said negative pressure chamber and said atmospheric pressure chamber and which is connected to said relief valve, and a second spring for biasing said second diaphragm; and a second line having an open end facing said first diaphragm and the other end communicating with said first line for connecting said negative pressure source and said relief valve drive unit, said relief valve control unit being so constructed that when said pressure in said supply line at a point upstream of said flow control valve exceeds said pressure downstream thereof by a value greater than a preset level, the opening of said second line is closed by said first diaphragm and said pressure in said negative pressure chamber is increased to open said relief valve.

6. In a filter regenerating apparatus comprising a particulate filter provided in an exhaust gas line from a diesel engine for trapping particulates in exhaust gas from said engine, an exhaust bypass for bypassing said particulate filter, and a burner provided upstream of said particulate filter receiving fuel and air, said exhaust gas being passed through said bypass while said particulates, when trapped in said filter in an amount exceeding a preset level, are burnt in said burner, the improvement wherein said apparatus further comprises a combustion control unit for establishing a timing of filter regeneration, thereby causing the exhaust gas to flow into said bypass and actuating said burner, a line for supplying air into said burner through an air supply unit, a flow control valve provided in said air supply line for regulating a cross-sectional area of said line, a flow control unit comprising pressure sensing means provided in said supply line at a point near said flow control valve, temperature sensing means for detecting the temperature of air in said supply line, a calculating section provided within said control unit for calculating an optimum position of said flow control valve according to the detected pressure and temperature, a valve drive unit connected to said flow control valve for driving said flow control valve according to the calculated position, a relief valve provided in said supply line for releasing part of the air in said line to the atmosphere, and a relief valve control unit for positioning said relief valve depending upon a difference between a pressure in said supply line at a point upstream of said flow control valve and a pressure at a point downstream thereof.

7. The apparatus according to claim 6, wherein said valve drive unit comprises a negative pressure chamber communicating with a negative pressure source, a chamber open to the atmosphere, a diaphragm which is partitioning said atmospheric pressure chamber and said negative pressure chamber and operatively associated with said flow control valve, a spring for biasing said diaphragm, and a valve switch provided between said negative pressure chamber and said negative pressure source for selectively establishing communication between said negative pressure chamber and the atmosphere and said negative pressure source, the position of said flow control valve being adjusted to a desired level by controlling the operation of said valve switch in accordance with an output from said calculating section.

8. The apparatus according to claim 7, wherein the position of said flow control valve is adjusted to a desired value by performing duty control of said valve switch in response to a signal from said calculating section.

9. The apparatus according to claim 7, wherein the position of said flow control valve is adjusted to a desired value by performing on-off control of said valve switch in response to a signal from said calculating section.

10. The apparatus according to claim 7, further comprising means for detecting a position of said flow control valve, the detected position being supplied to said calculating section for performing feedback control upon the position of said flow control valve so as to obtain a desired level.

11. The apparatus according to claim 7, wherein said relief valve control unit comprises a first chamber into which said pressure in said supply line at a point downstream of said flow control valve is introduced, a second chamber into which said pressure in said supply line at a point upstream of said flow control valve is introduced, a diaphragm partitioning said first and second chambers, and a spring for biasing said diaphragm, said relief valve control unit being so constructed that said relief valve opens when said pressure in said supply line at a point upstream of said flow control valve exceeds said pressure downstream thereof by a value greater than a preset level.

12. The apparatus according to claim 7, wherein said relief valve control unit comprises: a negative pressure regulating valve comprising a first chamber into which said pressure in said supply line at a point downstream of said flow control valve is introduced, a second chamber into which pressure upstream of said flow control valve is introduced, a first diaphragm partitioning said first and second chambers, and a first spring for biasing said first diaphragm; a relief valve drive unit comprising a negative pressure chamber connected to a negative source through a first line, a chamber open to the atmospheric pressure, a second diaphragm partitioning said negative pressure chamber and said atmospheric pressure chamber and which is connected to said relief valve, and a second spring for biasing said second diaphragm; and a second line having an open end facing said first diaphragm and the other end communicating with said first line for connecting said negative pressure source and said relief valve drive unit, said relief valve control unit being so constructed that when said pressure in said supply line at a point upstream of said flow control valve exceeds said pressure downstream thereof by a value greater than a preset level, the opening of said second line is closed by said first diaphragm and the pressure in said negative pressure chamber is increased to open said relief valve.

* * * * *